United States Patent [19]

Cooper et al.

[11] Patent Number: 4,746,380

[45] Date of Patent: May 24, 1988

[54] EXPLOSIVE COMPOUND COMPRISING AMMONIUM NITRATE AND GLYCINE

[75] Inventors: John Cooper, Ayr, Scotland; Vladmir Sujansky, Burwood, Australia

[73] Assignee: Imperial Chemical Industries PLC, London, England

[21] Appl. No.: 53,690

[22] Filed: May 26, 1987

[30] Foreign Application Priority Data

Jun. 11, 1986 [GB] United Kingdom ..... 8614228

[51] Int. Cl.[4] ..... C06B 45/00

[52] U.S. Cl. ..... 149/2; 149/36; 149/45; 149/46; 149/51; 149/55; 149/61; 149/70; 149/77; 149/88; 149/101; 149/105; 149/109.6; 562/575

[58] Field of Search ..... 149/2, 36, 46, 45, 88, 149/70, 109.6, 51, 55, 61, 101, 105, 77; 562/575

[56] References Cited

U.S. PATENT DOCUMENTS

| | | | |
|---|---|---|---|
| 3,956,040 | 5/1976 | Tezuka | 149/41 |
| 4,248,644 | 2/1981 | Healy | 149/2 |
| 4,507,161 | 3/1985 | Sujansky et al. | 149/2 |

*Primary Examiner*—Stephen J. Lechert, Jr.

*Attorney, Agent, or Firm*—Cushman, Darby & Cushman

[57] ABSTRACT

The invention relates to a new explosive compound which is an associated compound of ammonium nitrate and glycine and also includes explosive composition containing this compound.

The compound ANGC is prepared by a crystallization process preferably effected by cooling a melt or saturated solution containing ammonium nitrate and glycine.

ANGC is especially advantageous as an ingredient of low water content emulsion explosive compositions.

14 Claims, No Drawings

EXPLOSIVE COMPOUND COMPRISING AMMONIUM NITRATE AND GLYCINE

This invention relates to a new explosive compound and to explosive compositions and components of explosives containing the said compound. More particularly the invention relates to an association compound formed by reaction between ammonium nitrate (AN) and glycine. The invention also includes methods of preparing the said compound and a method of sensitising ammonium nitrate and explosive compositions containing ammonium nitrate.

AN is a commonly used constituent of many blasting explosive compositions. In a liquid phase it is capable of very fast reaction but, in compositions containing solid AN, the physical processes of melting, vaporisation and diffusion limit the reaction rate and adversely affect the ease of detonation (sensitivity), velocity of detonation, and critical diameter of detonation of the compositions. The problems with solid AN may be offset to some extent by using the AN in the form of fine crystalline material of microporous prills. However, fine crystals are difficult to prepare and the crystals tend to grow on storage. The user of microporous material reduces the density and consequently the bulk strength of the explosive compositions.

The present invention has arisen from work directed towards improving the explosive properties of solid phase AN in explosive compositions.

We have discovered that ammonium nitrate and glycine co-crystallize to form a crystalline association compound which has a melting point of about 135° C. and contains two moles. of AN and one mole. of glycine. This compound (hereinafter for convenience termed ANGC) has explosive properties markedly superior to those of ammonium nitrate or mixtures of ammonium nitrate with non-self-explosive fuel, for example, AN/fuel oil mixtures. ANGC is an oxygen negative compound and can, therefore, be usefully used as a sensitizing fuel constituent of explosive compositions in admixture with oxidising salt such as ammonium nitrate or ammonium perchlorate.

Thus the present invention consists in a new explosive compound (ANGC) which is an association compound of two moles AN and one mole of glycine. The formula of the new compound is $2NH_4NO_3/NH_2CH_2COOH$ and, expressed as percentages of the constituents, consists of 68% AN and 32% of glycine by weight. The invention also includes explosive compositions containing ANGC.

From another aspect the invention consists in a process for the preparation of ANGC by co-crystallizing two moles of AN and 1 mole of glycine from a mixture of AN and glycine. The crystallization is preferably effected by cooling a melt or saturated solution containing AN and glycine, although the compound may be formed in lesser yield by admixing particulate AN and glycine. The compound appears to be formed in any mixture containing ammonium nitrate and glycine in any proportions.

ANGC is itself a useful explosive and has physical and explosive properties appropriate for its use as an explosive primer or booster charge. It is also suitable as an energetic constituent of a blasting or propellant explosive composition. Because of its negative oxygen value it may be advantageously used in blasting explosive compositions in admixture with an oxidising salt.

Such compositions may be prepared by mixing glycine with more than the amount of AN required for combination with the glycine, and ANGC being formed in situ in the presence of the excess AN and any additional explosive ingredient. Thus an oxygen balanced composition may be made by mixing 17 parts by weight of glycine with 83 parts by weight of AN to give a composition containing 63.8 parts of ANGC and 36.2 parts of AN. This composition is much more sensitive than a balanced AN/fuel oil mixture and can be detonated in small diameters by a blasting detonator (i.e. it is cap-sensitive).

The ANGC of the invention is also a useful constituent, at least partially replacing AN, in other blasting compositions e.g. explosives containing nitroglycerine or trinitrotoluene as sensitizer; aqueous slurry explosive wherein ANGC is dispersed in an aqueous solution of oxidising salt; and emulsion explosive compositions containing a fuel phase and an oxidiser phase.

Explosive compositions of the invention may, in addition to AN and ANGC, comprise any oxidiser salt capable of releasing oxygen in the explosive environment for example ammonium perchlorate, sodium perchlorate, calcium perchlorate, sodium nitrate, potassium nitrate, calcium nitrate, urea perchlorate, hydrazine nitrate, guanidine nitrate or guanidine perchlorate.

ANGC is especially advantageous as an ingredient of low water content (less than 5% by weight) emulsion explosive compositions wherein it may be incorporated in an oxidiser melt which is emulsified with a liquid fuel. In some cases the composition may advantageously be formulated so that on cooling the emulsion solidifies. Solid emulsions may be formulated so as to be suitable for use as primers, bulk blasting explosives or propellants and may be cast hot or, after solidification, may be shaped as desired. The solid emulsions are preferably melt-in-fuel emulsions when formulated at elevated temperature, and preferably at least a portion of the solidified oxidiser droplets remain encapsulated in the continuous fuel phase in the solid emulsion.

Melt-in-fuel emulsions of the invention may advantageously contain a substance which forms an eutectic melt when heated with AN in order to reduce the melting point of the melt and consequently the formulation temperature of the emulsion. Such substances include inorganic oxidiser salts such as the nitrates of lead, sodium and calcium and organic compounds such as urea, methylamine nitrate and hexamethylene tetramine.

The fuel phase of emulsion explosives of the invention, which generally constitutes from 3 to 12% by weight of the emulsion, should be substantially insoluble in the oxidiser phase and should be fluid at a suitable temperature for emulsification with the oxidiser phase. Preferred fuels include refined (white) mineral oil, diesel oil, paraffin oil, benzene, toluene, paraffin wax, beeswax, woolwax and slackwax, dinitrotoluene and trinitrotoluene. The fuel phase may also, if desired, include a polymeric material for example polyisobutene, polyethylene or ethylene/vinyl acetate copolymer, or a polymer precursor.

The emulsion explosives of the invention advantageously contain an emulsifier, for example, a sorbitan sesquioleate, sorbitan mono-oleate sorbitan monopalmitate, sorbitan stearate, alkyl aryl sulphonate or a fatty amine. A discontinuous gaseous or void phase, for example hollow particles such as micro-balloons or fine gas bubbles, may also be included in the emulsion to enhance the sensitivity of the emulsion explosive.

The invention is further illustrated by the following Examples in which all parts and percentages are expressed by weight and by the accompanying drawing which is an infrared spectrum of the compound according to the invention. Examples 5 and 12 are included for comparison and are not Examples of the invention.

EXAMPLE 1

Confirmation of Compound Formation in AN/glycine mixtures by Melting Point determination Weighed mixtures of ammonium nitrate and glycine were fused together, solidified, ground up and filled into standard melting point tubes. On heating at a rate of 2° C./minute, the temperature at which the mixture was totally molten was recorded.

The melting points were:

| % glycine | melting point (°C.) |
|---|---|
| 0 | 169 |
| 10 | 135 |
| 15 | 118 |
| 20 | 123 |
| 25 | 126 |
| 30 | 133 |
| 32 | 135 |
| 35 | 132 |
| 40 | 127 |
| 50 | 130 |
| 60 | 141 |

The results are in agreement with formation of a compound from about 32% glycine and 68% AN, i.e. $2NH_4NO_3/NH_2CH_2COOH$.

The melting point pattern is as expected in an AB system with congruent compound formation. (cf. "Phase Equilibria", A Reisman, Academic Press, New York 1970 pp 217–28).

EXAMPLE 2

Confirmation of Compound formation by X-ray Diffraction and infra-red spectrum Mixtures of 30/70 glycine/AN and 40/60 glycine-/AN were fused, solidified and ground into a powder. X-ray powder diffraction on the 30/70 mixture showed no diffraction lines due to glycine, weak lines due to AN and strong lines due to another component. The 40/60 mixture showed weak glycine lines, no AN lines and strong lines due to another component (i.e. the new compound). A 32/68 mixture showed no AN or glycine lines but only those due to the new compound. The d-spacings (Angstrom units) for the compound grouped in the order of their visually assessed intensity were.

(1) 3.34, 2.70
(2) 5.78, 4.50, 3.99, 3.91
(3) 3.50, 2.49, 4.38
(4) 5.40, 3.22, 3.19, 2.85, 2.37
(5) 5.55, 3.68, 2.93, 2.77, 2.75, 2.62 2.57, 2.28, 2.24, 2.19, 2.09, 2.06

An infra-red spectrum determined for the compound prepared by fusing a 32/68 mixture of glycine/AN is shown on the accompanying drawing.

EXAMPLE 3

Confirmation of compound formation by Differential Scanning Calorimetry

Fused mixtures of glycine and ammonium nitrate were solidified and ground.

Phase (IV)–(III) and (III)–(II) transitions in AN were monitored by differential scanning calorimetry (DSC). As the glycine increased the size (endothermicity) of the transition decreased considerably more than would be expected from a purely diluent effect. At 30% glycine the solid/solid phase transitions of the AN/glycine mixture had virtually disappeared and above 32% glycine they were no longer evident i.e. there were no discrete AN crystals in the mixture. The absence of any decomposition peaks when mixtures containing above 32% glycine were heated until molten showed that the new compound (ANGC) was stable from 20° C. or below to its melting point.

A melting point diagram as described in Example 1 was confirmed by observing the melting points of the mixtures.

EXAMPLE 4

94 parts of ammonium nitrate and 6 parts of glycine were mixed together and added to 15 parts of water. The mixture was heated with stirring to about 60° C., maintained at this temperature for 30 minutes and then cooled to 5° C. The resultant product which was separated from the mother liquor by filtration was dried. Three plastic containers in the form of cylinders having a length of 90 millimeters and a diameter of 45 millimeters were filled with the dried product. The content of each of the cylinders was detonated successfully by means of a detonator containing a base charge of 0.6 gm of pentaerythritol tetranitrate (PETN).

EXAMPLE 5

For the purpose of comparison the general procedure of Example 4 was repeated except that no glycine was used. The recrystallized ammonium nitrate so obtained could not be detonated under the conditions used in Example 4, nor was detonation achieved when the detonator used in Example 4 was replaced by a combination of detonators consisting of two detonators with 0.6 gm PETN base charges and one detonator having a base charge of 0.4 gm PETN.

EXAMPLES 6 TO 9 INCLUSIVE

The general procedure of Example 4 was repeated except that the amounts of ammonium nitrate and glycine used were as set out in Table 1. The minimum amount of PETN required in a detonator base charge in order to detonate the composition is set out in Table 1. The detonators in each case contained a primary charge of 0.16 gm of lead azide.

TABLE 1

| Example | Ammonium Nitrate | Glycine | Detonator Minimum base charge (gm. PETN) |
|---|---|---|---|
| 6 | 91 parts | 9 parts | 0.4 |
| 7* | 83 parts | 17 parts | 0.4 |
| 8 | 81 parts | 19 parts | 0.4 |
| 9 | 71 parts | 29 parts | 0.6 |

*oxygen balanced mixture

EXAMPLE 10

The general procedure of Example 7 was repeated except that the plastic containers of that Example were replaced by cylinders of paper which were 250 mm. long and had a diameter of 45 mm. When the compositions were detonated by means of a detonator having a base charge of 0.4 gm PETN a velocity of detonation of 4350 m/sec. was obtained.

EXAMPLE 11

The general procedure of Example 10 was repeated except that the paper cylinders were 40 cm. long and had a diameter of 2.5 cm. A velocity of detonation of 2800 m/sec. was obtained.

EXAMPLE 12

For the purposes of comparison the general procedure of Example 10 was repeated but the explosive composition of that Example was replaced by a conventional ammonium nitrate-fuel oil explosive composition prepared from 94 parts of crushed prilled ammonium nitrate and 6 parts of diesel oil. Attempts to detonate the composition by means of a detonator having a base charge of 0.6 gm PETN failed.

EXAMPLE 13

A melt-in-fuel emulsion was prepared by emulsifying a melt phase and an oil phase as described below under high shear conditions at 100° C.

| | parts |
|---|---|
| Melt phase | |
| Ammonium nitrate | 64 |
| Glycine | 10 |
| Lithium nitrate | 15 |
| Sodium nitrate | 5 |
| Fuel phase | |
| Mineral oil | 4 |
| Octadecenylamine | 1 |
| Sorbitan mono-oleate | 1 |

The emulsion was allowed to cool to 40° C. and then to 70 parts of emulsion, 30 parts of RDX were added and the mixture cartridged. After 10 hours at ambient temperature the composition was totally solid. A 32 mm. cartridge at a composition density of 1.67 g/cc detonated at 6,900 mps when initiated by a detonator having a base charge of 0.8 g PETN in combination with a 4 gm. primer of pentolite (50/50 PETN/TNT).

EXAMPLE 14

An aqueous slurry explosive was prepared by mixing the following ingredients at 50° C. and adjusting the pH to 5.7 with acetic acid.

| | |
|---|---|
| Prilled AN | 27.7% |
| Crushed prilled AN | 41.0% |
| Sodium nitrate | 6.0% |
| Glycine | 12.0% |
| Sugar | 4.0% |
| Water | 8.0% |
| Guar gum | 0.6% |
| Starch | 0.6% |
| Potassium pyroantimonate | 0.02% |
| Sodium nitrite | 0.08% |

When cartridged in 2 inch diameter×24" long cartridges at a density of 1.08 g/ml the composition detonated when primed with 5 gm of pentolite (50/50 PETN/TNT), the velocity of detonation being 3800 m/sec.

EXAMPLE 15

A melt-in-fuel emulsion explosive was prepared by emulsifying a melt phase and an oil phase of the following composition at 100° C.

| | parts |
|---|---|
| Melt phase | |
| Ammonium nitrate | 66.7 |
| Lithium nitrate | 15.0 |
| Sodium nitrate | 5.0 |
| Glycine | 8.0 |
| Fuel phase | |
| Mineral oil | 1.4 |
| Microcrystalline wax | 1.2 |
| Paraffin wax | 1.2 |
| Sorbitan mono-oleate | 1.5 |

The emulsion was of putty-like consistency when cold, the droplets in the emulsion being liquid.

100 parts of the emulsion were mixed with 2.5 parts of glass micro-balloons (type C15/250) and cartridged in 32 mm diameter cardboard tubes at a density of 1.32 g/cc. The cartridges detonated when initiated with a detonator having a base charge of 0.2 g PETN.

EXAMPLE 16

A base melt-in-fuel emulsion explosive was prepared by emulsifying a melt phase and an oil phase of the following composition at 90° C.

| | parts |
|---|---|
| Melt phase | |
| Ammonium nitrate | 64.5 |
| Lithium nitrate | 15.0 |
| Sodium nitrate | 5.0 |
| Glycine | 10.0 |
| Fuel phase | |
| Mineral oil | 1.5 |
| Trinitrotoluene | 1.0 |
| Dinitrotoluene | 1.5 |
| Octadecylamine acetate | 1.5 |

73 parts of the base emulsion explosive were cooled to 40° C. and uniformly mixed with 20 parts of ammonium perchlorate, 5 parts of fine atomised aluminium and 2 parts of glass micro-balloons (type C15/250) were added. The mixture was cartridged by casting into 85 mm diameter cardboard tubes. After standing overnight at 5° C. the mixture had set solid. When initiated with a detonator having a base charge of 0.8 g PETN and a 28 g pentolite booster the cast explosive detonated.

EXAMPLE 17

A water-in-oil emulsion explosive was prepared by emulsifying an aqueous phase and an oil phase of the following composition:

| | parts |
|---|---|
| Aqueous phase | |
| Ammonium nitrate | 65.7 |
| Sodium nitrate | 13.0 |
| Water | 10.0 |
| Glycine | 7.0 |

-continued

| | parts |
|---|---|
| Oil phase | |
| Mineral oil | 3.8 |
| Sorbitan mono-oleate | 0.5 |
| Polyisobutenyl succinic anhydride (MW 1200)/ethanolamine (1:1 mole ratio) condensate | 1.0 |

2.5 parts of glass micro-balloons (type C15/250) were uniformly mixed into the emulsion and the emulsion was cartridged in 32 mm diameter cardboard tubes at a density of 1.14 g/cc. When initiated with a detonator having a base charge of 0.2 g PETN the cartridges detonated.

EXAMPLE 18

80 parts of fine ammonium nitrate were mixed with 10 parts of glycine and 5 parts of water to form a mixture containing ANGC and AN.

The mixture was dried (with occasional stirring). 10 parts of finely ground TNT were added with mixing and crushing and the resulting powder, of which all the particles were less than 25 μm, was cartridged in 32 mm diameter cardboard tubes at a density of 1.35 g/cc.

When initiated with a detonator having a base charge of 0.8 g PETN the cartridges detonated.

We claim:

1. A crystalline association compound of two moles of ammonium nitrate and one mole of glycine.

2. A solid explosive composition containing the compound as claimed in claim 1 and additional oxidising salt.

3. A composition as claimed in claim 2 wherein the additional oxidising salt comprises a salt selected from the group consisting of ammonium nitrate, sodium nitrate, potassium nitrate, calcium nitrate, guanidine nitrate, hydrazine nitrate, ammonium perchlorate, sodium perchlorate, calcium perchlorate, guanidine perchlorate and mixtures of any two or more of said salts.

4. A composition as claimed in claim 3 comprising 63.8 parts by weight of the compound as claimed in claim 1 and 36.2 parts by weight of ammonium nitrate.

5. A explosive composition comprising the compound as claimed in claim 1 and sensitiser selected from the group consisting of nitroglycerine or trinitrotoluene.

6. A solid emulsion explosive composition comprising a fuel phase, emulsifier and an oxidiser phase containing the compound as claimed in claim 1.

7. A solid emulsion explosive composition as claimed in claim 6 which is a melt-in-fuel emulsion when formulated at elevated temperature and, on cooling to ambient temperature, contains at least a portion of the oxidiser to the form of solid droplets encapsulated in a continuous fuel phase.

8. An emulsion explosive composition as claimed in claim 7 wherein the oxidiser melt comprises a substance selected from the group consisting of nitrates of lead, sodium and calcium; methylamine nitrate; hexamethylene tetramine; and urea.

9. A process for the preparation of the compound as claimed in claim 1 wherein two moles of ammonium nitrate and 1 mole of glycine are co-crystallized from a mixture of ammonium nitrate and glycine.

10. A process as claimed in claim 9 wherein the compound is crystallized by cooling a melt or saturated solution containing ammonium nitrate and glycine.

11. A solid explosive composition comprising the compound of claim 1 and prepared by mixing 17–32% by weight of glycine and 68–83% by weight of ammonium nitrate.

12. A solid emulsion explosive composition as claimed in claim 12 wherein the emulsifier is selected from the group consisting of long chain fatty amine or a derivative thereof.

13. A solid emulsion explosive composition as claimed in claim 12 wherein the emulsifier is selected from the group consisting of octadecenylamine and octadecylamine acetate.

14. A compound according to claim 1 of the formula $2NH_4NO_3/NH_2CH_2COOH$, said compound being characterized by its explosive properties.

* * * * *

UNITED STATES PATENT AND TRADEMARK OFFICE

CERTIFICATE OF CORRECTION

PATENT NO. : 4,746,380

DATED : May 24, 1988

INVENTOR(S) : COOPER ET AL

It is certified that error appears in the above-identified patent and that said Letters Patent is hereby corrected as shown below:

ON THE TITLE PAGE,
Assignee should read as follows:

Assignee: Imperial Chemical Industries PLC,
London, England and
ICI Australia Limited,
Melbourne, Australia

Signed and Sealed this

Sixth Day of December, 1988

*Attest:*

DONALD J. QUIGG

*Attesting Officer*

*Commissioner of Patents and Trademarks*